United States Patent [19]

Wang

[11] Patent Number: 4,870,983

[45] Date of Patent: Oct. 3, 1989

[54] INFLATING ARTICLE WITH INTEGRALLY ASSOCIATED PUMP

[76] Inventor: Cheng-Chung Wang, 12th Fl., No. 440, Sec. 4, Jen-Ai Rd., Taipei, Taiwan

[21] Appl. No.: 211,755

[22] Filed: Jun. 27, 1988

[51] Int. Cl.[4] ..... A45B 19/02

[52] U.S. Cl. ..... 135/20 B

[58] Field of Search ..... 135/20 B, 75, 20 R

[56] References Cited

U.S. PATENT DOCUMENTS

| | | | |
|---|---|---|---|
| 2,401,252 | 5/1946 | Klimashesky | 135/20 B |
| 2,625,946 | 1/1953 | Kaston | 135/20 B |

FOREIGN PATENT DOCUMENTS

| | | | |
|---|---|---|---|
| 1814204 | 7/1979 | Fed. Rep. of Germany | 135/20 B |
| 2252823 | 6/1975 | France | 135/20 B |
| 2408325 | 7/1979 | France | 135/75 |
| 456065 | 5/1968 | Switzerland | 135/20 B |
| 489500 | 3/1976 | U.S.S.R. | 135/20 B |

*Primary Examiner*—Henry E. Raduazo
*Assistant Examiner*—Lan Mai
*Attorney, Agent, or Firm*—Ladas & Parry

[57] ABSTRACT

The invention provides an inflatable article which comprises an inflatable envelope having an enclosing wall made of a flexible heat sealable material, and a pump means having an enclosed pump housing made of a flexible heat sealable material, the enclosed pump housing having a first open flanged end heat sealed to the enclosing wall, the pump housing being compressible and expandable so that it can be operated for pumping air. Single-direction valves are provided for permitting air to follow into the pump housing and the interior of the envelope.

8 Claims, 6 Drawing Sheets

INFLATING ARTICLE WITH INTEGRALLY ASSOCIATED PUMP

BACKGROUND OF THE INVENTION

This invention relates to an inflatable article and particularly to the construction of an inflatable article incorporating a pump which provides an improvement over conventional inflating methods such as inflating the article with the mouth or inflating with a pump which is a separate piece from the inflatable article.

An object of the invention is to provide an improved construction of an inflatable article which has an integrally connected inflating pump through which the article can be inflated conveniently at any place without taking along an additional inflating pump.

Another object of the invention is to provide a simple inflating pump for an inflatable article which can be easily operated by a user of every age.

SUMMARY OF THE INVENTION

The invention provides an inflatable article which comprises an inflatable envelope having an enclosing wall made of a flexible heat sealable material, and a pump means having an enclosed pump housing made of a flexible heat sealable material. The enclosed pump housing has a first open flanged end heat sealed to the enclosing wall and an opposite second end, the pump housing being compressible and expandable so that it can be operated for pumping air. A first signal-direction valve is disposed in the enclosing wall and communicated with the pump housing, the pump means further having a second single-direction valve disposed in the wall of the pump housing for the inlet of air.

In one aspect of the invention, the pump housing is provided with an interior tube and a coil spring around the interior tube. The spring is used to stretch or expand the pump housing after it is depressed.

In another aspect of the invention, the pump housing is fabricated in the form of a bellow so that the housing can expand after the housing is depressed.

In still another aspect of the invention, the pump housing is made of a rubber material so that the housing can expand after being compressed.

In still another aspect of the invention, the pump housing is provided with interior ribs to stretch the housing after it is compressed.

The present exemplary preferred embodiment will be described in detail with reference to the accompanying drawings, in which:

DETAILED DESCRIPTION OF THE PREFERRED EMBODIMENTS

The preferred embodiments of the present invention are illustrated with reference to FIGS. 1 to 9 in which like elements are represented by like numerals.

Figure 1:
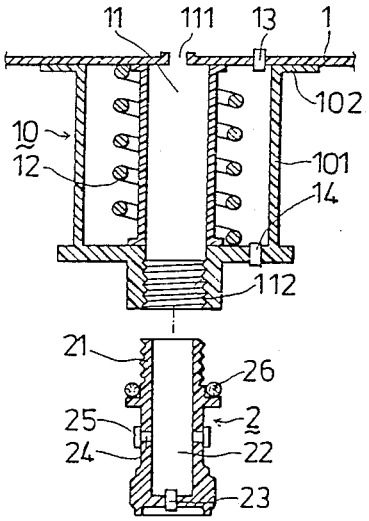
FIG. 1 is a sectional view of a preferred embodiment of the pump of the present invention.
Figure 2:
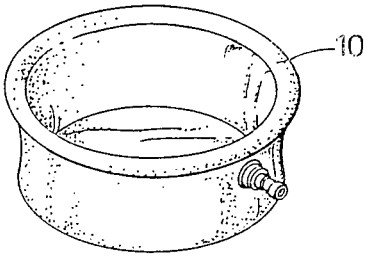
FIG. 2 shows an inflatable pool incorporating the present invention.
Figure 3:
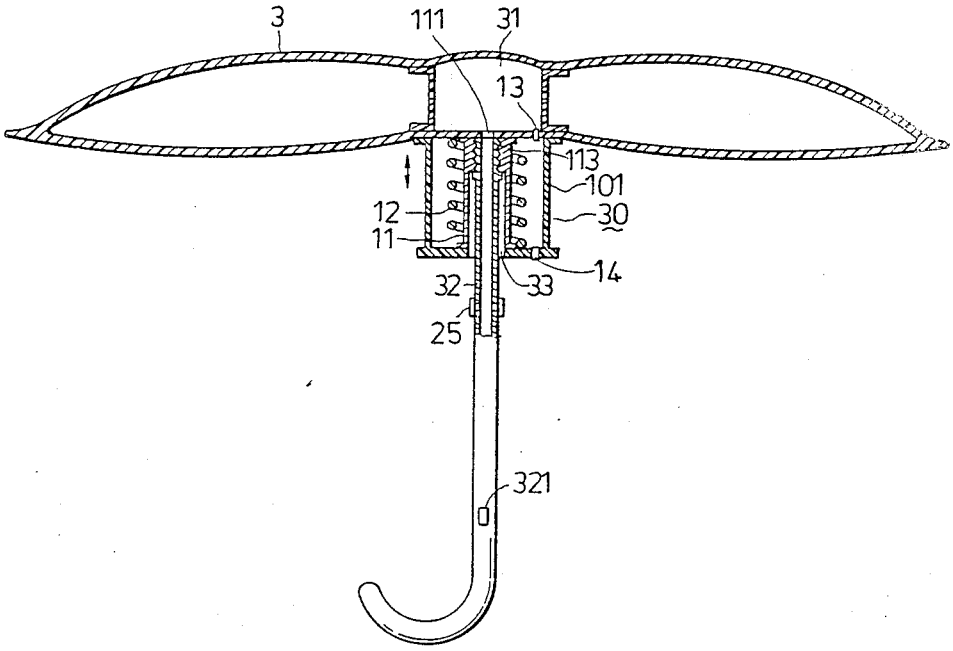
FIG. 3 shows an inflatable umbrella incorporating the pump of FIG. 1.

Referring to FIGS. 1 to 3, a pump 10 for an inflatable article 1 is shown, including a housing 101 made of a flexible heat sealable material which has a first open end with a flange 102 heat sealed to the wall of an inflatable envelope 1. The second end of the housing 101 is provided with a threaded tubular member 112 which is communicated with an interior tube 11 extending from the first end to the second end of the housing 101. Around the interior tube 11 is a helical spring 12. A single direction valve 13 is provided in an inlet hole of the wall of the envelope 1, and a single direction valve 14 is provided in an inlet hole of the housing of the pump 10. An opening 111 communicated with the interior tube 11 is provided in the wall of the envelope 1.

A screw end 21 of an outer tube 2 is inserted threadedly into the tubular member 112 and has one end provided with a mouth 23, a gas relief opening 24 and a rubber cover ring 25 which is sleeved tightly around the outer tube 2 to cover up the gas relief opening 24. A sealing ring 26 is disposed around the outer tube 2 to prevent leakage.

Figure 1A:
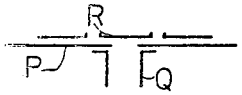
FIGS. 1A and 1B are schematic views showing single-direction valves that can be used in the present invention.
Figure 1B:
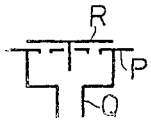

During pumping, the outer tube 2 is depressed against the action of the spring and is released to permit the housing 10 to expand by the action of the spring so that air flows into the envelope 1 through the valves 13 and 14. When the pressure in the envelope 1 exceeds a predetermined amount, the excess air from the envelope 1 flows into the interior tube 11 through the opening 111, then pushes the rubber ring 25 and escapes from the outer tube 2. The pump 10 of the present invention not only can be operated by hand but also can be used as a spout through which air can be blown into the envelope with the mouth. The valves 13 and 14 are known devices such as that shown in FIGS. 1A or 1B wherein P, Q & R represent respectively a part of an enveloping sheet, a rigid plastic unit and a semirigid or flexible gas impervious sheet.

FIG. 2 shows that the pump 10 is attached to an inflatable pool so that the pool can be inflated without using an additional pumping device.

FIG. 3 shows an inflatable umbrella incorporating another embodiment of the pump of the present invention. The inflatable umbrella includes an inflatable canopy 3, and a pump 30 attached to the bottom side of the central portion 31 of the canopy. The pump 30 is substantially similar to the pump 10 except that the interior tube of 11 is provided with an inner threaded portion 113 instead of an outer tubular threaded portion 112 of the pump 10.

A shaft 32 of the umbrella 3 is inserted into the interior tube 11 and coupled threadedly to the threaded portion 113. A gas relief valve 25 is provided in the shaft. To deflate the canopy, a valve 321 can be provided at the lower part of the shaft 32.

Figure 4:
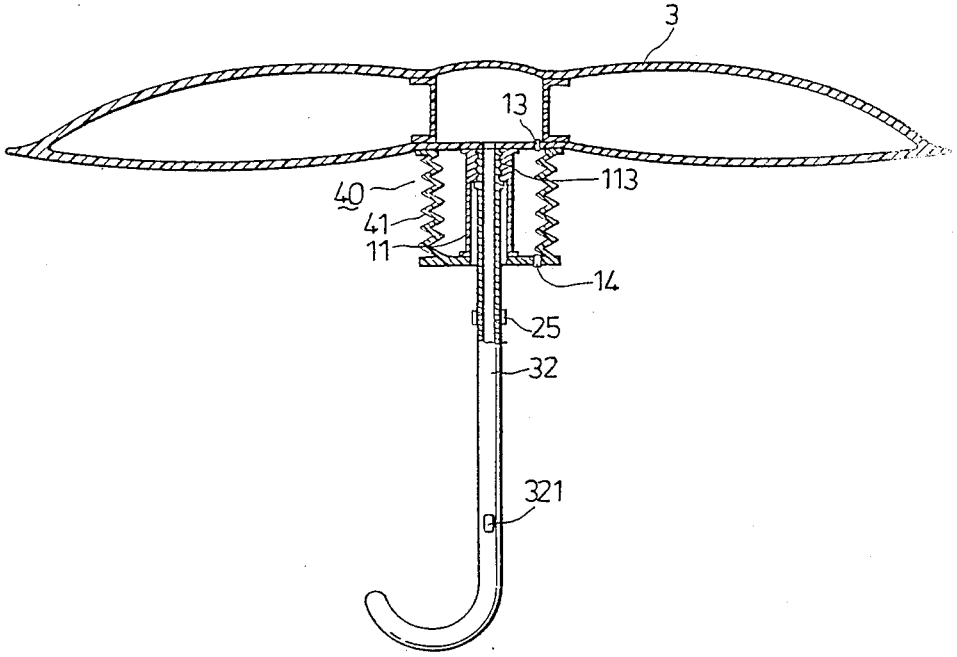
FIG. 4 shows an inflatable umbrella incorporating another embodiment of the pump of the invention.

FIG. 4 shows still another embodiment of the pump of the invention. This embodiment includes a pump 40 which has a bellows-like housing 41, an interior tube 11, and single direction valves 13 and 14. Although no helical spring 12 is provided in this embodiment, the housing 41 can expand after compression due to its bellow-like construction.

Figure 5:
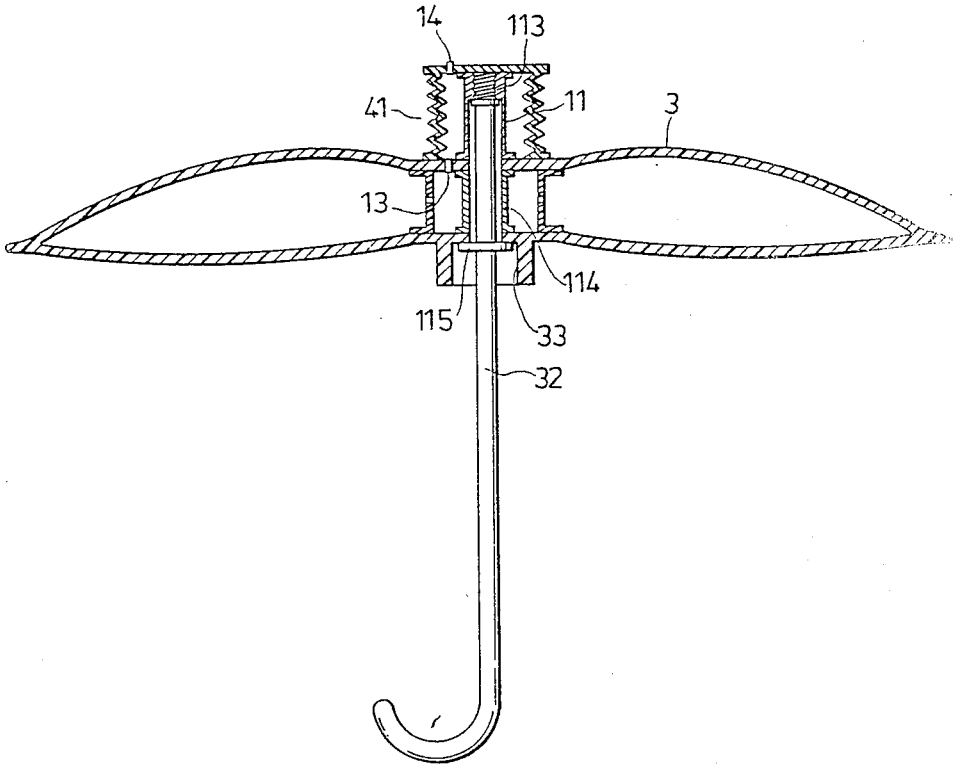
FIG. 5 shows an inflatable umbrella incorporating still another embodiment of the pump of the invention.

FIG. 5 shows still another embodiment of the pump of the present invention wherein a pump housing 41 is attached to the upper side of the central portion of the canopy 3. The central portion of the canopy 3 is provided with another interior tube 11 in alignment with the interior tube 114 of the pump housing 41. The shaft 32 of the umbrella is inserted into the tubes 11 and 114 and is provided with an annular flange 115. A grip member 33 is attached to the bottom side of the canopy 3 around the shaft 32. In operation, the user may grip the grip member 33 with one hand, grip the shaft 32 with another hand, and alternatly pull and release the shaft to effect pumping.

Figure 6:
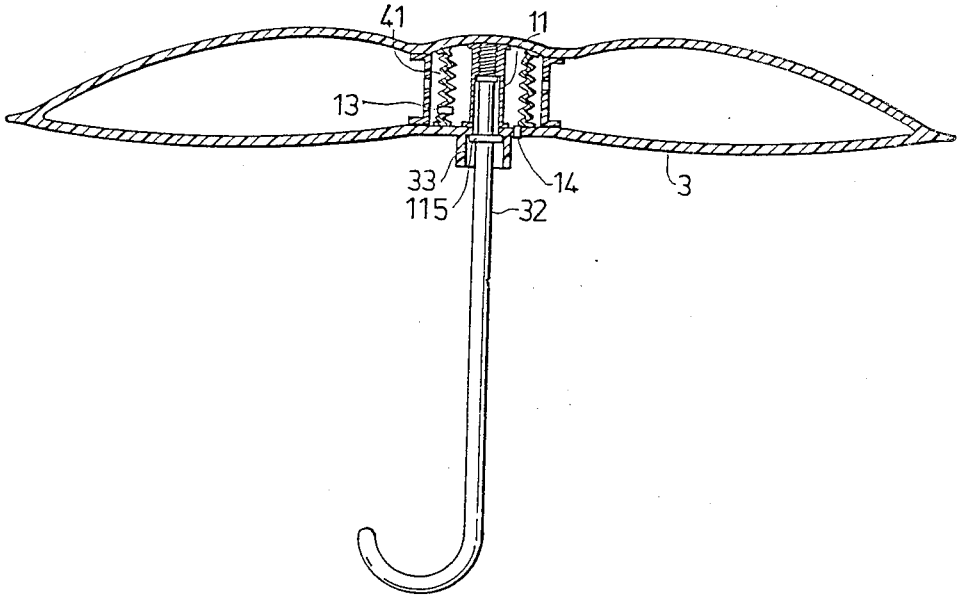
FIG. 6 shows an inflatable umbrella incorporating still another embodiment of the pump of the invention.

FIG. 6 shows still another embodiment of the pump of the present invention wherein a pump housing 41 is disposed in the inside of the central portion of the canopy 3. The construction of the embodiment is substantially similar to that of the embodiment of FIG. 5. This embodiment can be operated in the same manner as the operation of the embodiment of FIG. 5.

Figure 7:
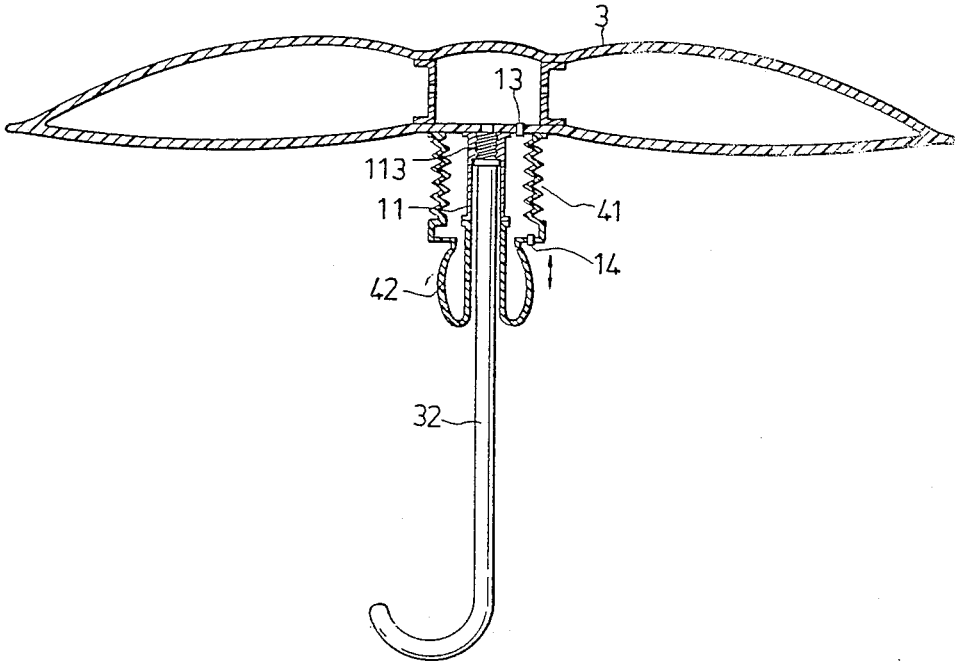
FIG. 7 shows an inflatable umbrella incorporating still another embodiment of the pump of the invention.

FIG. 7 shows still another embodiment of the invention wherein an annular handle 42 is incorporated in the pump housing 41 so that one may hold the handle 42 with one hands to operate the pump housing 41.

Figure 8:
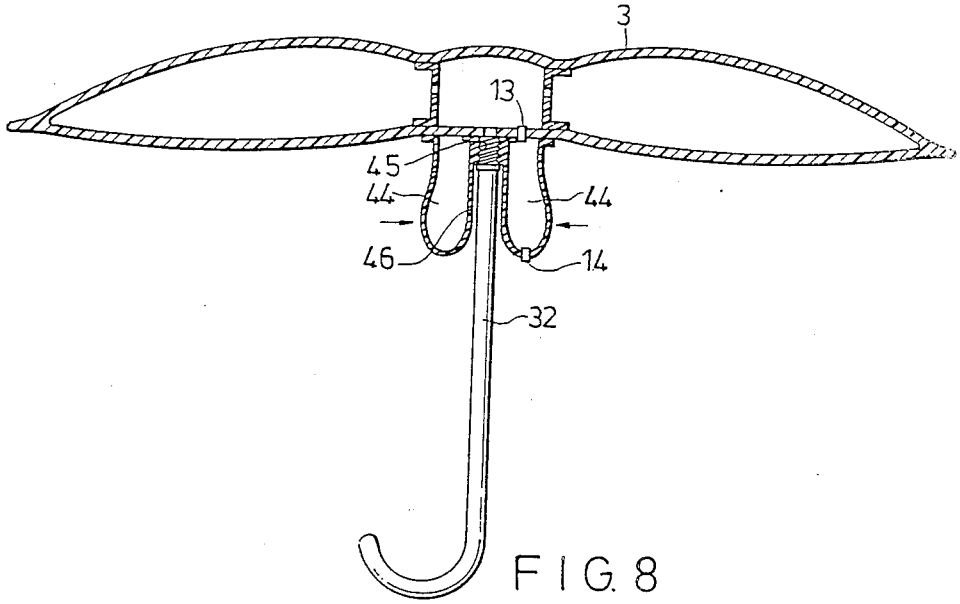
FIG. 8 shows an inflatable umbrella incorporating still another embodiment of the pump of the invention.

FIG. 8 shows still another embodiment of the invention wherein a rubber housing 44 is attached to the lower side of the central portion of the canopy 3. The rubber housing 44 is in an annular shape having an inner periphery 46 provided with a threaded portion 45 to engage with the top end of the shaft 32. Air can be pumped into the interior of the canopy 3 by alternately squeezing and releasing the rubber housing 44.

Figure 9:
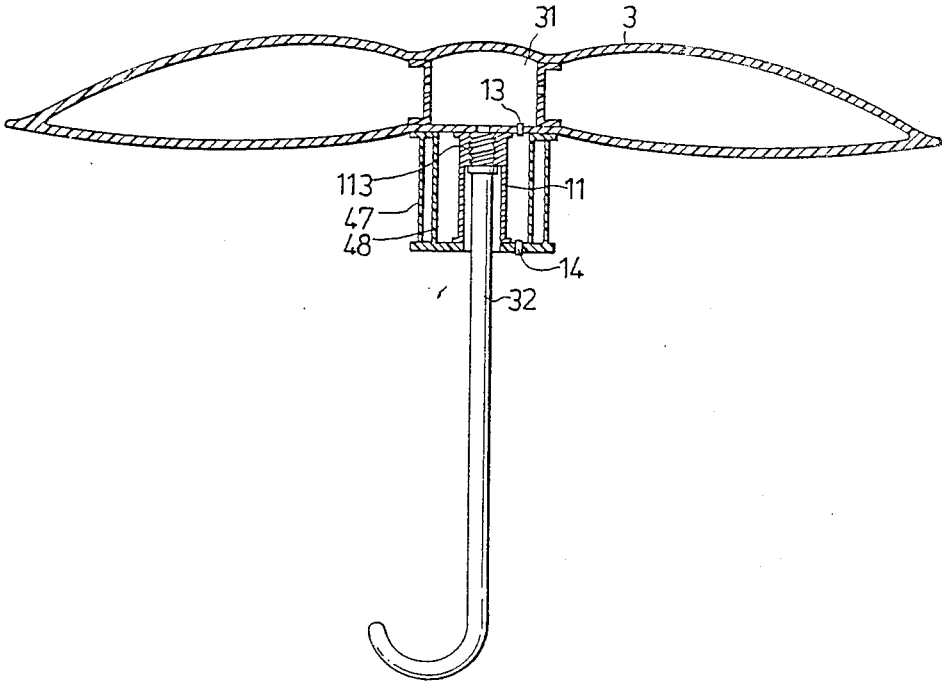
FIG. 9 shows an inflatable umbrella incorporating still another embodiment of the pump of the invention.

FIG. 9 shows still another embodiment of the invention wherein a pump housing 47 is attached to the bottom side of the central portion of the canopy 3 and the housing 47 has thereinside ribs 48 which serve the same purpose as the spring 12 of the previous embodiments, that is, to stretch the housing 47 after the housing is collapsed upon compression.

With the invention thus explained, it is apparent that numerous modifications and variations can be made without departing from the scope of the invention. It is therefore intended that the invention be limited as indicated in the appended claims.

What I claim is:

1. An inflatable umbrella comprising:

an inflatable envelope having an enclosing wall made of a flexible material;

a pump means having an enclosed pump housing made of a flexible material, said enclosed pump housing having a first open flange end fixed to said enclosing wall and an opposite second end, said pump housing being compressible and expandable so that it can be operated for pumping air;

an interior portion of said pump means, extending from said first end to said second end of said housing so that an inner chamber of said interior portion is in fluid communication with said inflatable envelope, forms an outer chamber between an exterior wall of said interior portion and said pump housing;

a first single-direction valve disposed in said enclosing wall and in fluid communication with said outer chamber; and a second single-direction valve disposed in said pump housing and in fluid communication with said outer chamber for the inlet of air.

2. An inflatable umbrella as claimed in claim 1, wherein an excessive pressure relief valve is in fluid communication with said interior portion.

3. An inflatable umbrella as claimed in claim 1, wherein a coiled spring is provided around the interior portion.

4. An inflatable umbrella as claimed in claim 3, wherein said enclosing wall of said inflatable envelope further has a gas outlet opening in fluid communication with said inner chamber of said interior portion, said pump means further having an outer portion outside said pump housing and connected to said interior portion, said outer portion having a peripheral wall which is provided with a gas outlet opening and a rubber ring sleeved snugly around said outer portion to cover said gas outlet opening of said outer portion, said rubber ring permitting an excess amount of air to be released from said inflatable envelope.

5. An inflatable umbrella as claimed in claim 1, wherein said pump housing has a bellows-like construction.

6. An inflatable umbrella as claimed in claim 1, wherein said pump housing is provided with ribs extending in said pump housing from said first end to said second end to stretch said pump housing after said pump housing is compressed.

7. An inflatable umbrella as claimed in claim 1, wherein said pump housing is made of rubber.

8. An inflatable umbrella comprising;

an inflatable envelope having a canopy-like shape and having a central compartment and a multi-compartmented radial portion, a shaft having one end connected to said envelope adjacent to said central compartment, a pump means having a pump housing having a first open flange end fixed to said envelope adjacent said central compartment and an opposite second end, said pump housing being compressible and expandable so that it can be operated for pumping air, said pump housing further having an interior portion extending from said first end to said second end of said pump housing and firmly receiving a portion of said shaft so that said shaft is in fluid communication with an inner chamber defined by said interior portion, a first single-direction valve disposed in said enclosing wall and in fluid communication with said pump housing so as to permit air to enter said envelope, a first air outlet in said enclosing wall, adjacent to said central compartment, so that said central compartment is in fluid communication with said inner chamber of said interior portion, a second air outlet disposed in said shaft in fluid communication with said inner chamber, so as to allow the air within the shaft to escape from said shaft, a second single-direction valve disposed at said second end of said pump housing for the inlet of air.

* * * * *